US005577159A

United States Patent [19]

Shoham

[11] Patent Number: 5,577,159

[45] Date of Patent: Nov. 19, 1996

[54] TIME-FREQUENCY INTERPOLATION WITH APPLICATION TO LOW RATE SPEECH CODING

[75] Inventor: Yair Shoham, Berkeley Heights, N.J.

[73] Assignee: AT&T Corp., Murray Hill, N.J.

[21] Appl. No.: 449,184

[22] Filed: May 24, 1995

Related U.S. Application Data

[63] Continuation of Ser. No. 959,305, Oct. 9, 1992, abandoned.

[51] Int. Cl.[6] ..... G10L 3/02; G10L 9/00

[52] U.S. Cl. ..... 395/2.15; 395/2.14; 395/2.16; 395/2.2

[58] Field of Search ..... 395/2, 2.28, 2.74, 395/2.14, 2.16, 2.2

[56] References Cited

U.S. PATENT DOCUMENTS

| | | | |
|---|---|---|---|
| 4,860,355 | 8/1989 | Copperi | 381/36 |
| 4,910,781 | 3/1990 | Ketchum et al. | 381/36 |
| 4,937,873 | 6/1990 | McAulay et al. | 395/2.74 |
| 4,975,955 | 12/1990 | Taguchi | 381/36 |
| 4,991,215 | 2/1991 | Taguchi | 381/38 |
| 5,048,088 | 9/1991 | Taguchi | 395/2.28 |
| 5,127,053 | 6/1992 | Koch | 381/31 |
| 5,138,661 | 8/1992 | Zinser et al. | 381/35 |
| 5,140,638 | 8/1992 | Moulsley et al. | 381/36 |
| 5,305,332 | 4/1994 | Ozawa | 395/2.74 |

FOREIGN PATENT DOCUMENTS

| | | | |
|---|---|---|---|
| 0296764 | 12/1988 | European Pat. Off. | G10L 9/14 |
| 0413391A2 | 2/1991 | European Pat. Off. | G10L 9/14 |
| 0573216 | 8/1993 | European Pat. Off. | G10L 9/14 |
| WO A 92/22 891 | 6/1992 | WIPO | G10L 9/14 |
| 9401860 | 1/1994 | WIPO | G10L 9/08 |

OTHER PUBLICATIONS

Transient Analysis of Speech Signals Using Wigner Time Frequency Representation ICASSP–89: 1989 International Conference on Acoustics, Speech and Signal Processing, Velez et al. May 1989 vol. 4.

W. B. Kleijn and W. Granzow "Methods for Waveform Interpolation in Speech Coding," Digital Signal Processing 1, 215–230 (1991).

W. B. Kleijn "Continuous Representations in Linear Predictive Coding," Proc. IEEE ICASSP'91, vol. S1, 201–204 (May 1991).

L. R. Rabiner and R. W. Schafer "Digital Processing of Speech Signals," Prentice–Hall Inc., 38–42 (1978).

P. Kroon and E. F. Deprettere "A Class of Analysis–by–Synthesis Predictive Coders for High Quality Speech Coding at Rates Between 4.8 and 16 kbits/s," IEEE Journal on Selected Areas in Communications, vol. 6, No. 2, 353–363 (Feb. 1988).

M. R. Schroeder and B. S. Atal "Code–Excited Linear Prediction (CELP): High–Quality Speech at Very Low Bit Rates," Proc. IEEE ICASSP'85, vol. 3, 937–940 (Mar. 1985).

*Primary Examiner*—Allen R. MacDonald
*Assistant Examiner*—Richemond Dorvil
*Attorney, Agent, or Firm*—Katharyn E. Olson

[57] ABSTRACT

A new method for high quality speech coding, Timing-Frequency Interpolation (TFI) which offers advantages over conventional CELP (code-excited linear predictive) algorithms for low rate coding. The method, provides a perceptually advantageous framework for voiced speech processing. The general formulation of the TFI technique is described.

19 Claims, 6 Drawing Sheets

TIME-FREQUENCY INTERPOLATION WITH APPLICATION TO LOW RATE SPEECH CODING

This application is a continuation of application Ser. No. 07/959305, filed on Oct. 9, 1992, now abandoned.

TECHNICAL FIELD

The present invention relates to a new method for high quality speech coding at low coding rates. In particular, the invention relates to processing voiced speech based on representing and interpolating the speech signal in the time-frequency domain.

BACKGROUND OF THE INVENTION

Low rate speech coding research has recently gained new momentum due to the increased national and global interest in digital voice transmission for mobile and personal communication. The Telecommunication Industry Association (TIA) is actively pushing towards establishing a new "half-rate" digital mobile communication standard even before the current North-American "full rate" digital system (IS54) has been fully deployed. Similar activities are taking place in Europe and Japan. The demand, in general, is to advance the technology to a point of achieving or exceeding the performance of the current standard systems while cutting the transmission rate by half.

The voice coders of the current digital cellular standards are all based on code-excited linear prediction (CELP) or closely related algorithms. See M. R. Schroeder and B. S. Atal, "Code-Excited Linear Predictive (CELP): High Quality Speech at Very Low Bit Rates," *Proc. IEEE ICASSP'85*, Vol. 3, pp. 937–940, March 1985; P. Kroon and E. F. Deprettere, "A Class of Analysis-by-Synthesis Predictive Coders for High Quality Speech Coding at Rates Between 4.8 and 16 Kb/s," *IEEE J. on Sel. Areas in Comm.*, SAC-6(2), pp. 353–363, February 1988. Current CELP coders deliver fairly high-quality coded speech at rates of about 8 Kbps and above. However, the performance deteriorates quickly as the rate goes down to around 4 Kbps and below.

SUMMARY OF THE INVENTION

The present invention provides a method and apparatus for the high-quality compression of speech while avoiding many of the costs and restrictions associated with prior methods. The present invention is illustratively based on a technique called Time-Frequency Interpolation ("TFI").

TFI illustratively forms a plurality of Linear Predictive Coding parameters characterizing a speech signal. Next, TFI generates a per-sample discrete spectrum for points in the speech signal and then decimates the sequence of discrete spectra. Finally, TFI interpolates the discrete spectra and generates a smooth speech signal based on the Linear Predictive Coding parameters.

BRIEF DESCRIPTION OF THE DRAWING

Other features and advantages of the invention will become apparent from the following detailed description taken together with the drawings in which.

DETAILED DESCRIPTION

I. INTRODUCTION

Figure 1:
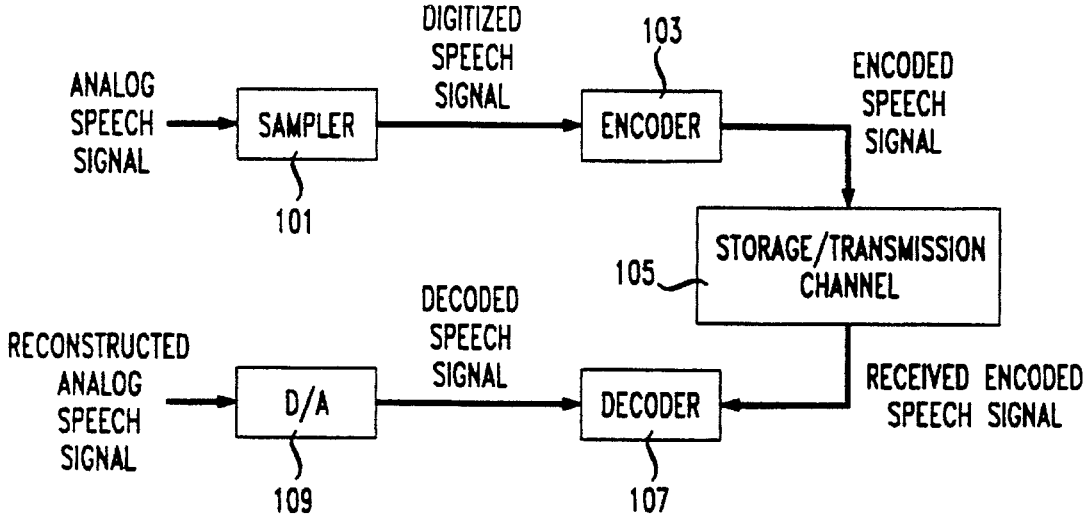
FIG. 1 illustrates a system for encoding speech.

FIG. 1 presents an illustrative embodiment of the present invention which encodes speech. Analog speech signal is digitized by sampler 101 by techniques which are well known to those skilled in the art. The digitized speech signal is then encoded by encoder 103 according to a prescribed rule illustratively described herein. Encoder 103 advantageously further operates on the encoded speech signal to prepare the speech signal for the storage or transmission channel 105.

After transmission or storage, the received encoded sequence is decoded by decoder 107. A reconstructed version of the original input analog speech signal is obtained by passing the decoded speech signal through a D/A converter 109 by techniques which are well known to those skilled in the art.

The encoding/decoding operations in the present invention advantageously use a technique called Time-Frequency Interpolation. An overview of an illustrative Time-Frequency Interpolation technique will be discussed in Section II before the detailed discussion of the illustrative embodiments are presented in Section III.

II. An Overview of Time-Frequency Interpolation

Time-Frequency Representation

Time-Frequency Representation (TFR), as defined herein, is based on the concept of short-time per-sample discrete spectrum sequence. Each time n on a discrete-time axis is associated with an M(n)-point discrete spectrum. In a simple case, each spectrum is a discrete Fourier transform (DFT) of a time series x(n), taken over a contiguous time segment $[n_1(n), n_2(n)]$, with $M(n)=n_2(n)-n_1(n)+1$. Note that the segments may not be equal in size and may overlap. Although not strictly necessary, we assume that n lies in its segment, namely, $n_1(n)<n<n_2(n)$. In this case, the n-th spectrum is conventionally given by:

$$X(n, K) = \sum_{m=n_1(n)}^{n_2(n)} x(m) e^{-j\frac{2\pi}{M(n)} Km} \tag{1}$$

The time series x(n) may be over-specified by the sequence X (n,K) since, depending on the amount of segment overlapping, there may be several different ways of reconstructing x(n) from X(n,K). Exact reconstruction, however, is not the main objective in using TFR. Depending on application, the "over-specifying" feature may, in fact, be useful in synthesizing signals with certain desired properties.

In a more general case, the spectrum assigned to time n may be generated in various ways to achieve various desired effects. The general-case spectrum sequence is denoted by Y(n,K) to distinguish between the straightforward case of Eq. (1) and more general transform operations that may utilize linear and non-linear techniques like decimation, interpolation, shifts, time (frequency) scale modification, phase manipulations and others.

We denote by $y(n,m)=F_n^{-1}\{Y(n,K)\}$ the inverse transform of Y(n,K), obtained by the operator $F_n^{-1}$. If Y(n,K)=X(n,K), then, by definition, y(n,m)=x(m) for $n_1(n)<m<n_2(n)$. Outside this segment, y(n,m) is a periodic of that segment and, in general, is not equal to x(m). Given the set of signals y(n,m), as derived from Y(n,K), a new signal z(n) is synthesized by using a time-varying window operator $W_n=\{w(n,m)\}$:

$$z(m)=W_nF_n^{-1}\{Y(n,K)\}=\sum_n w(n,m)y(n,m) \tag{2}$$

Figure 2:
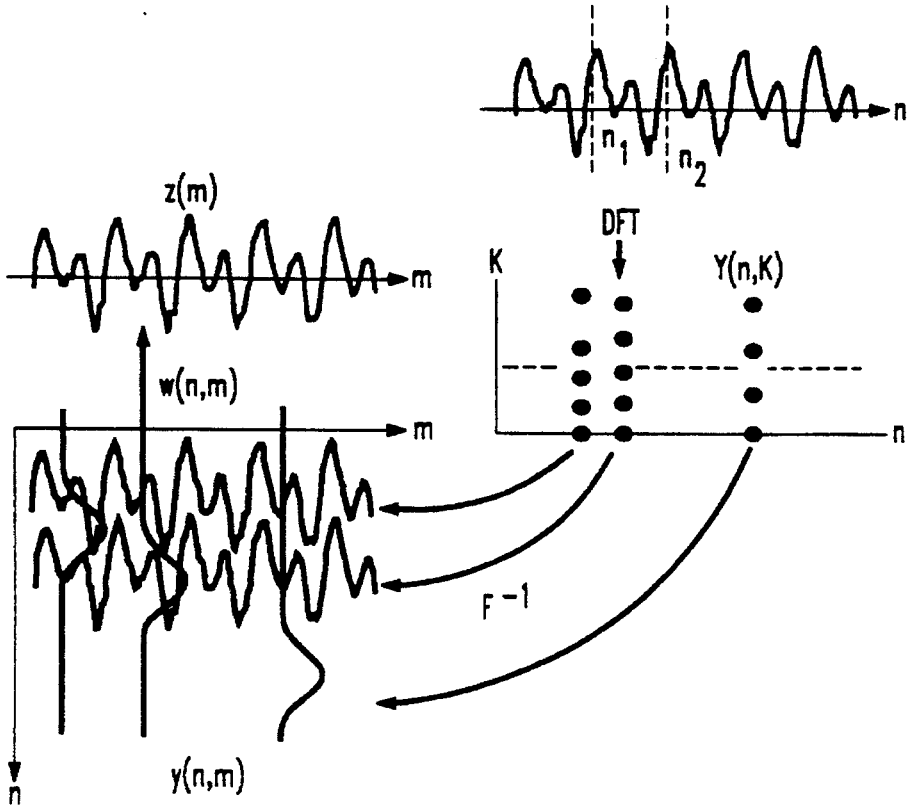
FIG. 2 illustrates Time Frequency Representation.

The TFR process is illustrated in FIG. 2 which shows a typical sequence of spectra in a discrete time-frequency domain (n,K). Each spectrum is derived from one time-domain segment. The segments usually overlap and need not be of the same size. The figure also shows the corresponding signals y(n,m) in the time-time domain (n,m). The window functions w(n,m) are shown vertically along the n-axis and the weighted-sum signal z(m) is shown along the m-axis.

The general definition of the TFR as above does not set time boundaries along the n-axis and it is non-causal since future (as well as past) data is needed for synthesis of the current sample. In real situations, time limits must be set and, as an illustrative convention, it is assumed that the TFR process takes place in a time frame [0 , . . . , N−1], and that no data is available for n≧N. Past data (n<0), however, is available for processing the current frame.

The TFR framework, as defined above is general enough to apply in many different applications. A few examples are signal (speech) enhancement, pre- and postfiltering, time scale modification and data compression. In this work, the focus is on the use of TFR for low-rate speech coding. TFR is used here as a basic framework for spectral decimation, interpolation and vector quantization in an LPC-based speech coding algorithm. The next section defines the decimation-interpolation process withing the TFR framework.

Time-Frequency Interpolation

Time-frequency interpolation (TFI) refers here to the process of first decimating the TFR spectra Y(n,K) along the time axis n and then interpolating missing spectra from the survivor neighbors. The term TFI refers to interpolation of the frequency spacings of the spectral components. A more detailed discussion on that aspect is given below.

For the coding of voiced speech, i.e. where the vocal tract is excited by quasi periodic pulses of air, see L. R. Rabiner and R. W. Schafer, *Digital Processing of Speech Signals* (Prentice Hall, 1978), TFR combined with TFI provides a useful domain in which coding distortions can be made less objectionable. This is so because the spectrum of voiced speech, especially when synchronized to the speech periodicity, changes slowly and smoothly. The TFI approach is a natural way of exploiting these speech characteristics. It should be noted that the emphasis is on interpolation of spectra and not waveforms. However, since the spectrum is interpolated on a per-sample basis, the corresponding waveform tends to sound smooth even though it may be significantly different from the ideal (original) waveform.

For convenience, the convention of aligning the decimation process with time frame boundaries is used. Specifically, all spectra but Y(N−1,K) are set to zero. The resulting nulled spectra are then interpolated from Y(N−1,K) and Y(−1,K) the latter being the survivor spectrum of the previous frame. Various interpolation functions can be applied, some of which will be discussed later. In general we have:

$$Y(n,K)=I_n(Y(-1,K),Y(N-1,K))n=0,\ldots,N-1 \tag{3}$$

where the $I_n$ operator denotes an interpolation function along the n-axis. The corresponding signals y(n,m) are, then, $$y(n,m)=F_n^{-1}\{I_n(Y(-1,K),Y(N-1,K))\}\ n=0,\ldots,N-1 \tag{4}$$

where the $F_n^{-1}$ operator indicates inverse DFT, taken at time n, from frequency axis K to the time axis m. The entire TFI process is, therefore, formally described by the general expression:

$$\begin{aligned} z(m) &= \sum_{n=0}^{N-1} w(n,m)\,F_n^{-1}\{I_n(Y(-1,K),Y(N-1,K))\} \\ & m=0,\ldots,N-1 \\ &= W_nF_n^{-1}I_n\{Y(-1,K)Y(N-1,K)\} \end{aligned} \tag{5}$$

Note that, in general, the operators $W_n$, $F_n^{-1}$, $I_n$ do not commute, namely, interchanging their order alters the result. However, in some special cases they may partially or totally commute. For each special case, it is important to identify whether or not commutativity holds since the complexity of the entire procedure may be significantly reduced by changing the order of operations.

In the next section, some special classes of TFI will be discussed, in particular, those useful for low-rate speech coding.

Some Classes of TFI

The formulation of TFI as in Eq. (5) is very general and does not point to any specific application. The following sections provide detailed descriptions of several embodiments of the present invention. In particular, four classes of TFI that may be practical for speech applications are described below. Those skilled in the art will recognize that other embodiments of the TFI application are possible.

1. Linear TFI

In one aspect of the invention, linear TFI is used. Linear TFI is the case where $I_n$ is a linear operation on its two arguments. In this case, the operators $F_n^{-1}$ and $I_n$, which, in general do not commute, may be interchanged. This is important since performing the inverse DFT prior to interpolating may significantly reduce the cost of the entire TFI algorithm. The interpolation is of the form $I_n(u,v)=\alpha(n)u+\beta(n)v$, which gives:

$$Y(n,K)=\alpha(n)Y(-1,K)+\beta(n)Y(N-1,K)n=0,\ldots,N-1 \tag{6}$$

Note that, although $I_n$ is a linear operator, the interpolation functions α(n) and β(n) are not necessarily linear in n and linear TFI is not a linear interpolation in that sense.

Straightforward manipulations of Eq. (4), (5) and (6) gives:

$$z(m)=\alpha(m)\,y(-1,m)+\beta(m)\,y(N-1,m) \tag{7}$$

where $$\alpha(m)=\sum_{n=0}^{N-1} w(n,m)\,\alpha(n)\ \beta(m)=\sum_{n=0}^{N-1} w(n,m)\,\beta(m) \tag{8}$$

Eq. (7) shows that linear TFI can be performed directly on two waveforms corresponding to the two survivor spectra at the frame boundaries. Eq. (8) shows that, in this special case, the window functions w(n,m) do not have a direct role in the TFI process. They may be used in a one-time off-line computation of α(m) and β(m). In fact, α(m) and β(m) may be specified directly, without the use of w(n,m).

Linear TFI with linear interpolation functions $\alpha(m)$, $\beta(m)$ is simple and attractive from implementation point of view and has previously been used in similar forms see, B. W. Kleijn, "Continuous Representations in Linear Predictive Coding," *Proc. IEEEICRSSP'91*, Vol. S1, pp. 201–204, May 1991; B. W. Kleijn, "Methods for Waveform Interpolation in Speech Coding," *Digital Signal Processing*, Vol. 1, pp. 215–230, 1991. In this case, the interpolation functions are typically defined as $\beta(m)=m/N$ and $\beta(m)=1-\beta(m)$, which means that z(m) is simply a gradual change-over from one waveform to the other.

2. Magnitude-Phase TFI

This aspect of the invention is an important example of non-linear TFI. Linear TFI is based on linear combination of complex spectra. This operation does not, in general, preserve the spectral shape and may generate a poor estimate of the missing spectra. Simply stated, if A and B are two complex spectra, then, the magnitude of $\alpha A+\beta B$ may be very different from that of either A or B. In speech processing applications, the short-term spectral distortions generated by linear TFI may create objectionable auditory artifacts. One way to overcome this problem is to use magnitude-preserving interpolation. $I_n(.,.)$ is defined so as to separately interpolate the magnitude and the phase of its arguments. Note that in this case $I_n$ and $F_n^{-1}$ do not commute and the interpolated spectra have to be explicitly derived prior to taking the inverse DFT.

In low-rate speech coding applications, the magnitude-phase approach may be pushed to an extreme case where the phase is totally ignored (set to zero). This eliminates haft of the information to be coded while it still produces fairly good speech quality due to the spectral-shape preservation and the inherent smoothness of the TFI.

3. Low vs. High Rate TFI

In another aspect of the invention the TFI rate is defined as the frequency of sampling the spectrum sequence, which is clearly 1/N. The discrete spectrum Y(n,K) corresponds to one M(n)-size period of y(n,m). If N>M(n), the periodically-extended parts of y(n,m) take part in the TFI process. This case is referred to as Low-Rate TFI (LR-TFI). LR-TFI is mostly useful for generating near-periodic signals, particularly in low-rate speech coding.

When N<M(n), the extended part of y(n,m) does not take part in the TFI process. This High-Rate TFI (HR-TFI) can be used, in principle, to process any signal. However, it is most efficient for near-periodic signals because of the smooth evolution of the spectrum. Usually, in HR-TFI, the spectra are taken over overlapping time segments. Note that there are no fundamental restrictions on the TFI rate other than 1/N>0.

In speech coding, the TFI rate is a very important factor. There are conflicting requirements on the bit rate and the TFI rate. HR-TFI provide smooth and accurate description of the signal, but a high bit rate is needed to code the data. LR-TFI is less accurate and more prone to interpolation artifacts but a lower bit rate is required for coding the data. It seems that a good tradeoff can only be found experimentally by measuring the coder performance for different TFI rates.

4. TFI with Time-Scale Modification

In a further aspect of the invention, Time Scale Modification (TSM) is employed. TSM amounts to dilation or contraction of a continuous-time signal x(t) along the time axis. The operation may be time-variable as in z(t)=x(c(t)t). On a discrete-time axis, the similar operation z(m)=x(c(m)m) is, in general, undefined. To get z(m), one has to first transform x(m) back to its continuous-time version, time-scale, and finally resample it. This procedure may be very costly. Using DFT (or other sinusoidal representations), TSM can be easily approximated as $$z(m) \approx \sum_{K=0}^{M-1} X(K)\, e^{j\frac{2\pi K}{M} c(m)\, m} \tag{9}$$

It is emphasized that Eq. (9) is not a true TSM but only an approximation thereof. It, however, works fairly well for periodic signals and with a modest amount of dilation or contraction. This pseudo-TSM method is very useful in voiced speech processing since it allows for very fine alignment with the changing pitch period. Indeed, we make this method an integral pan of the TFI algorithm by defining $F_n^{-1}$ in Eq. (4) to be $$F_n^{-1}\{Y(n, K)\} = \sum_{K=0}^{M(n)-1} Y(n, K)\, e^{j\frac{2\pi K}{M(n)} c(m)\, m} = y(n, m) \tag{10}$$

Notice the two time indices: n is the time at which a DFT snapshot was taken over a segment of size M(n). m is a time axis in which inverse DFT is done with time scale modification using the TSM function c(m). The function c(m) is usually indirectly defined by choosing a particular interpolation strategy in the fundamental phase domain $\Psi(n,m)=2\pi c(m)m/M(n)$. The phase interpolation is performed along the m-axis and, as implied by the above notation, it may be different for each of the waveforms y(n,m). Various interpolation strategies may be employed, see references by Kleijn, supra. The one used in the low-rate coder will be described later.

In most cases, it is possible and useful to make the operator $F_n$ completely independent of n. In this case, the phase is arbitrarily disassociated from the DFT size and is said to depend on m only. It is then determined by the chosen interpolation strategy, along with two boundary conditions at m=0 and m=N−1. For speech processing, the boundary conditions are usually given in terms of two fundamental frequencies (pitch values). The DFT size is made independent of n by simply using one common size $M=\max_n M(n)$ and appending zeros to all spectra shorter than M. Note that M is usually close to the local period of the signal, but the TFI allows any M. Since the phase is now independent of the DFT size, namely, of the original frequency spacing, one has to make sure that the actual spacing made by the phase $\Psi(m)$ does not cause spectral aliasing. This is very much dependent upon how Y(n,K) is interpolated from the boundary spectra and on how the actual size of Y(n,k) is determined. One advantage of the TFI system, as formulated here, is that spectral aliasing, due to excessive time-scaling, can be controlled during spectral interpolation. This is hard to do directly in the time domain.

The time-invariant operator $F^{-1}$ is now given by:

$$F^{-1}\{Y(n, K)\} = \sum_{K=0}^{M-1} Y(n, K)\, e^{j\Psi(m)K} = y(n, m) \tag{11}$$

Note that the operator $F^{-1}$ now commutes with the operator $W_n$, which is advantageous for low-cost implementations.

A special case of TSM is Fractional Circular Shift (FCS) which is very useful for fine alignment of two periodic signal. FCS of an underlying continuous-time periodic signal, given by z(t)=x(t−dt), can be approximated by inverse DFT:

$$z(m) \approx \sum_{K=0}^{M-1} X(K)\, e^{j\frac{2\pi K}{M}(m-dt)} \tag{12}$$

where dt is the desired fractional shift. It may indeed be viewed as a special case of TSM by defining c(m)=m(1−dt/m). FCS is usually viewed as a phase modification of the spectrum Y(n,K), with the modified spectrum given by:

$$Y'(n, K, dt) = Y(n, K)\, e^{j\frac{2\pi K}{M(n)}\, dt} \tag{13}$$

The use of FCS in the low-rate coder will be described below.

5. Parameterized TFI

A final aspect of the invention deals with the use of DFT parameterization techniques. In HR-TFI, the number of terms involved per time unit may be much greater then that of the underlying signal. In some applications, it is possible to approximate the DFT by a reduced-size parametric representation without incurring a significant loss of performance. One simple way of reducing the number of terms is to non-uniformly decimate the DFT. Spectral smoothing techniques could also be used for this purpose. Parametrized TFI is useful in low-rate speech coding since the limited bit budget may not be sufficient for coding all the DFT terms.

III. An Illustrative Embodiment

Low-Rate Speech Coding Based on TFI

Figure 3:
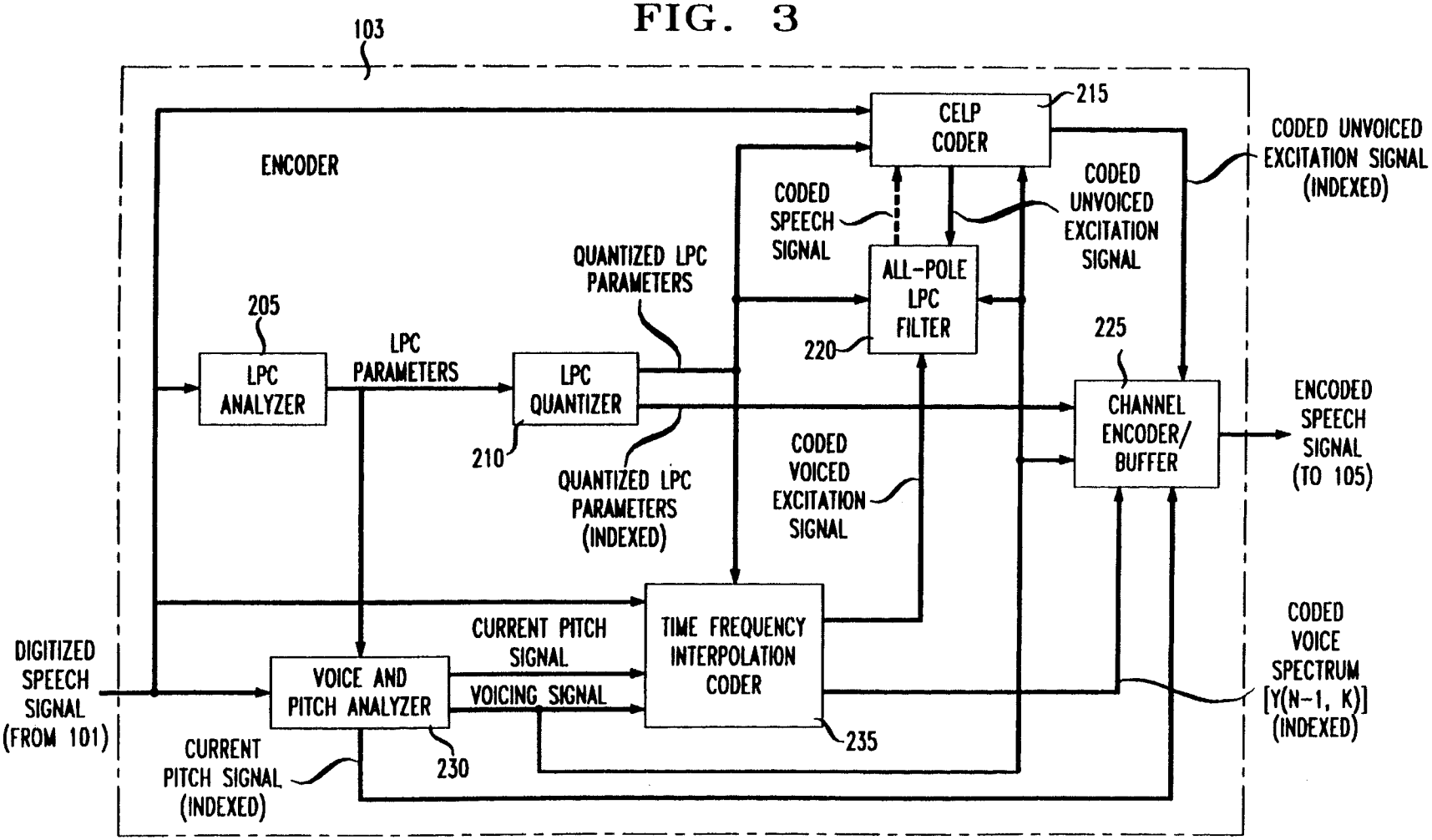
FIG. 3 illustrates a block diagram of a TFI-based low rate speech coder system.

This section provides a detailed description of a speech coder based on TFI. A block diagram of an illustrative coder in accordance with the present invention is shown in FIG. 3. Coder 103 begins operation by processing the digitized speech signal through a classical Linear Predictive Coding (LPC) Analyzer 205 resulting in a decomposition of spectral envelope information. It is well known to those skilled in the art how to make and use the LPC analyzer. This information is represented by LPC parameters which are then quantized by the LPC Quantizer 210 and which become the coefficients for an all-pole LPC filter 220.

Voice and pitch analyzer 230 also operates on the digitized speech signal to determine if the speech is voiced or unvoiced. The voice and pitch analyzer 230 generates a pitch signal based on the pitch period of the speech signal for use by the Time-Frequency Interpolation (TFI) coder 235. The current pitch signal, along with other signals as indicated in the figures, is "indexed" whereby the encoded representation of the signal is an "index" corresponding to one of a plurality of entries in a codebook. It is well known to those of ordinary skill in the art how to compress these signals using well-known techniques. The index is simply a shorthand, or compressed, method for specifying the signal. The indexed signals are forwarded to the channel encoder/buffer 225 so they may be properly stored or communicated over the transmission channel 105. The coder 103 processes and codes the digitized speech signal in one of two different modes depending on whether the current data is voiced or unvoiced.

In the unvoiced mode, (i.e. where the vocal tract is excited by a broad spectrum noise source, see Rabiner, supra,), the coder uses Code-Excited Linear-Predictive (CELP) coder 215. See M. R. Schroeder and B. S. Atal, "Code-Excited Linear Predictive (CELP): High Quality Speech at Very Low Bit Rates," *Proc. IEEE Int'l. Conf. ASSP*, pp. 937–940, 1985; P. Kroon and E. F. Deprettere, "A Class of Analysis-by-Synthesis Predictive Coders for High-Quality Speech Coding of Rates Between 4.8 and 16 Kb/s," *IEEE J. on Sel. Areas in Comm.*, Vol. SAC-6(2), pp. 353–363, Feb. 1988. CELP coder 215 advantageously optimizes the coded excitation signal by monitoring the output coded signal. This is represented in the figure by the dotted feedback line. In this mode, the signal is assumed to be totally a periodic and therefore there is no attempt to exploit long-term redundancies by pitch loops or similar techniques.

Figure 4:
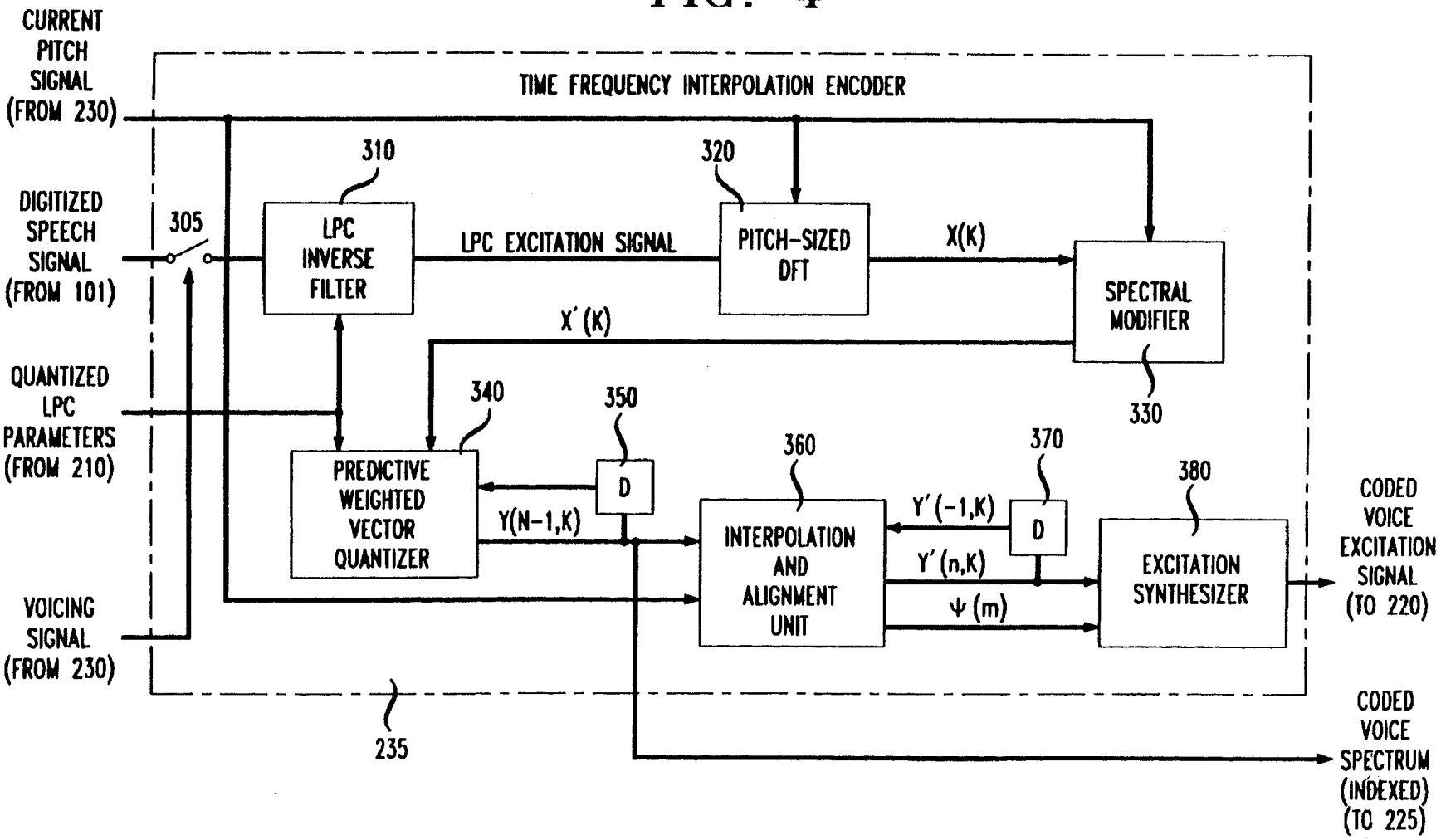
FIG. 4 illustrates Time-Frequency Interpolation Coder.

When the signal is declared voiced, the CELP mode is turned off and the TFI coder 235 is turned on by switch 305. The rest of this section discusses this coding mode. The various operations that take place in this mode are shown in FIG. 4. The figure shows the logical progression of the TFI algorithm. Those skilled in the art will recognize that in practice, and for some specific systems, the actual flow may be somewhat different. As shown in the figure, the TFI coder is applied to the LPC residual, or LPC excitation signal, obtained by inverse-filtering the input speech with LPC inverse filter 310. Once per frame, an initial spectrum X (K) is derived by applying a DFF using the pitch-sized DFT 320 where the DFT length is determined by the current pitch signal. A pitched-sized DFT is advantageously used but is not required. This segment, however, may be longer than one frame. The spectrum is then modified by the spectral modifier 330 to reduce its size, and the modified spectrum is quantized by predictive weighted vector quantizer 340. Delay 350 is required for this quantizing operation. These operations yield the spectrum Y(N-1,K), that is, the spectrum associated with the current frame end-point. The quantized spectrum is then transmitted along with the current pitch period to the interpolation and alignment unit 360.

Figure 5:
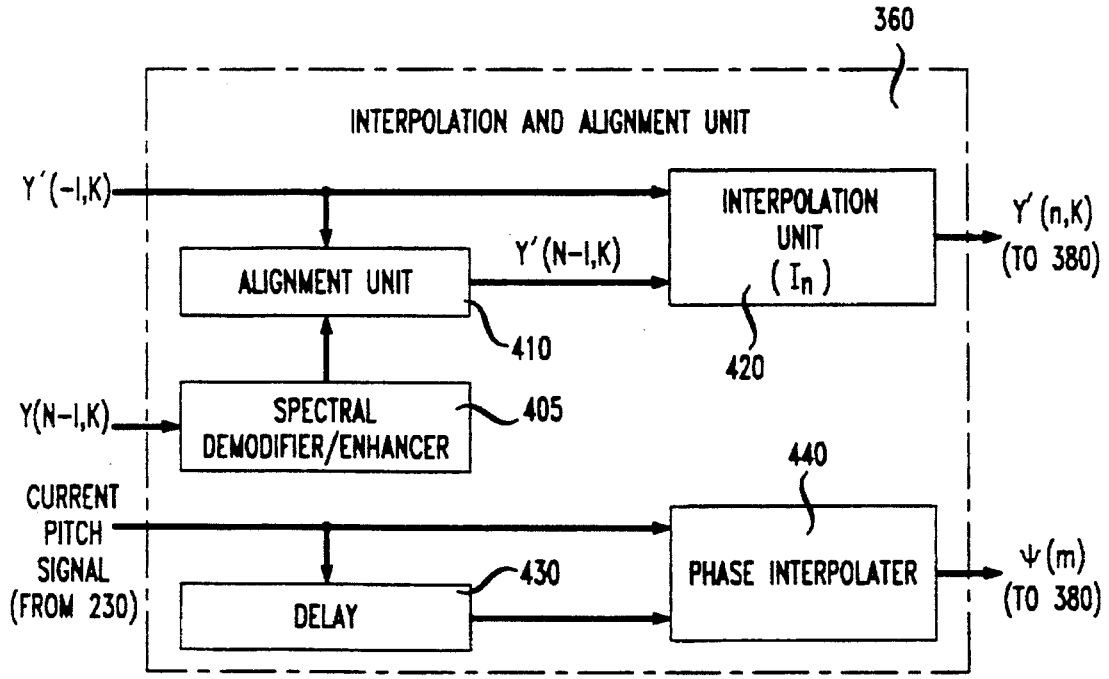
FIG. 5 illustrates a block diagram of the Interpolation and Alignment Unit.

FIG. 5 illustrates a block diagram of an illustrative interpolation and alignment unit such as that shown at 360 in FIG. 4. The current spectrum, previous quantized spectra from delay block 370, and the current pitch signal are input to this unit. Current spectrum, Y(N−1,K) is first enhanced by the spectral demodifier/enhancer 405 to reverse or alter the operations performed by spectral modifier 330. The remodified spectrum is then aligned in the alignment unit 410 with the spectra of the previous frame by FCS operation and interpolated by the interpolation unit 420. Additionally, the phase is also interpolated. The unit 360 yields the spectral sequence Y'(n,K) and phase Ψ(m) which are input to the excitation synthesizer 380.

Figure 6:
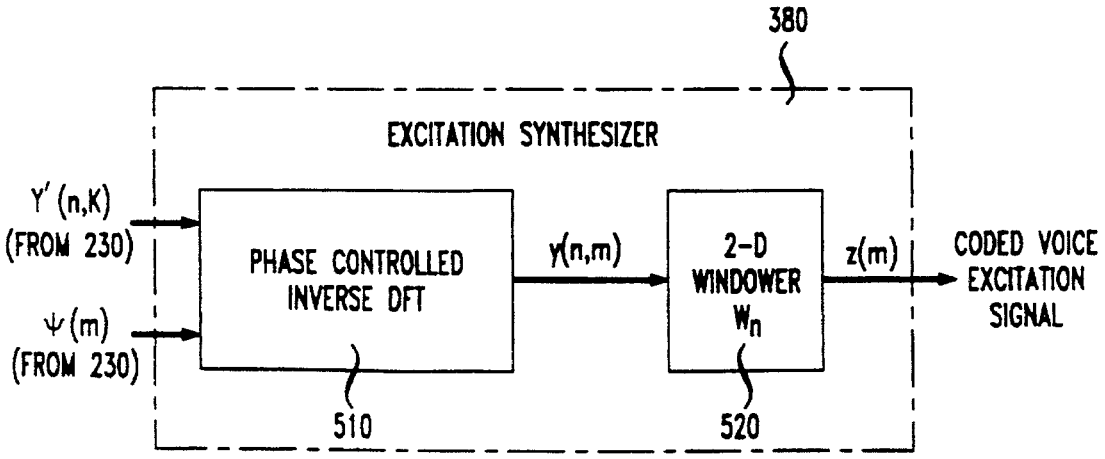
FIG. 6 illustrates a block diagram of the Excitation Synthesizer.

In the excitation synthesizer 380, shown in detail in FIG. 6, the spectrum is convened to a time sequence, y(n,m), by the inverse DFT unit 510, and the time sequence is windowed by the 2-dimensional windower 520 to yield the coded voice excitation signal.

Figure 7:
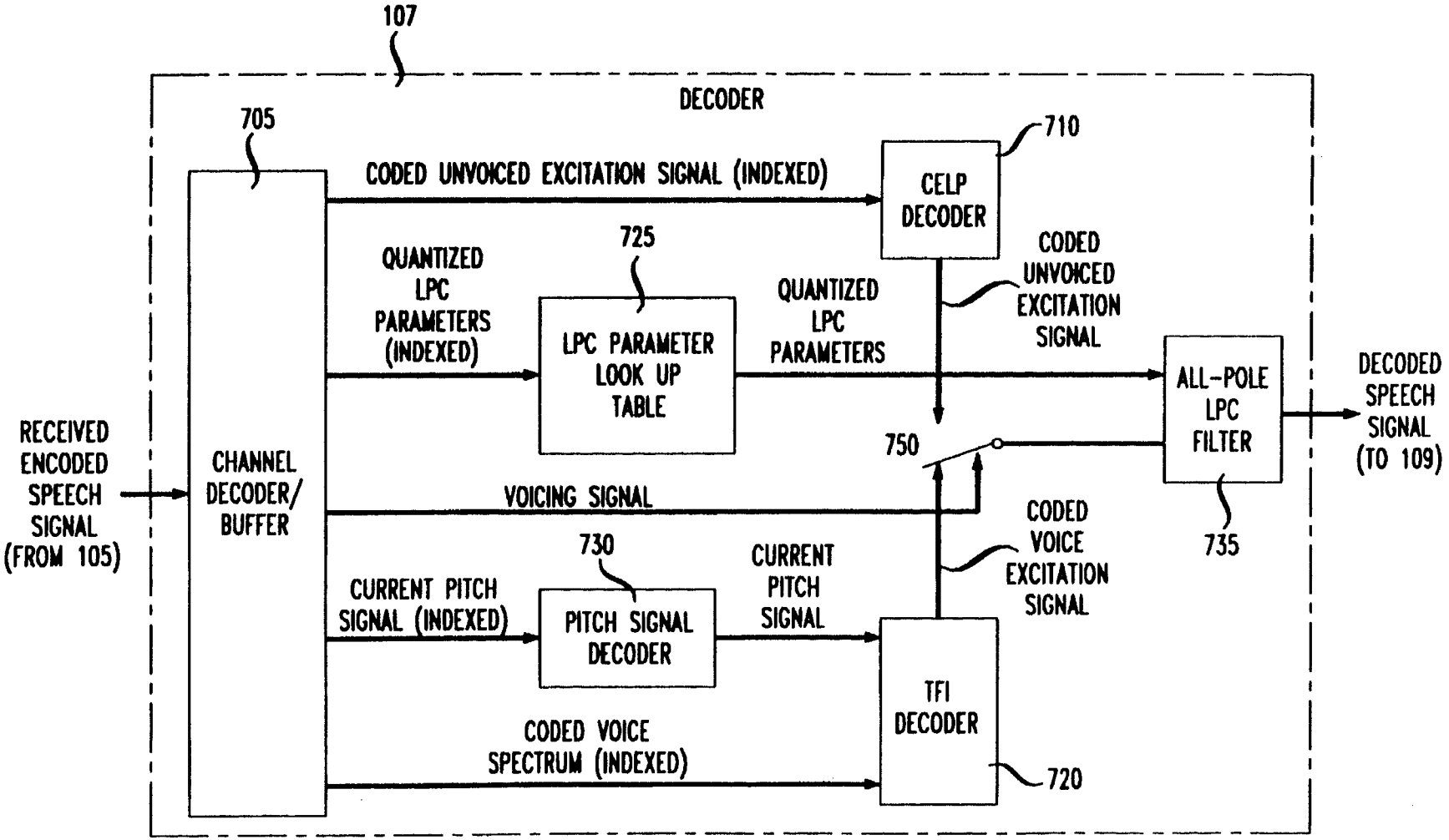
FIG. 7 illustrates a block diagram of a TFI-based low rate speech decoder system.
Figure 8:
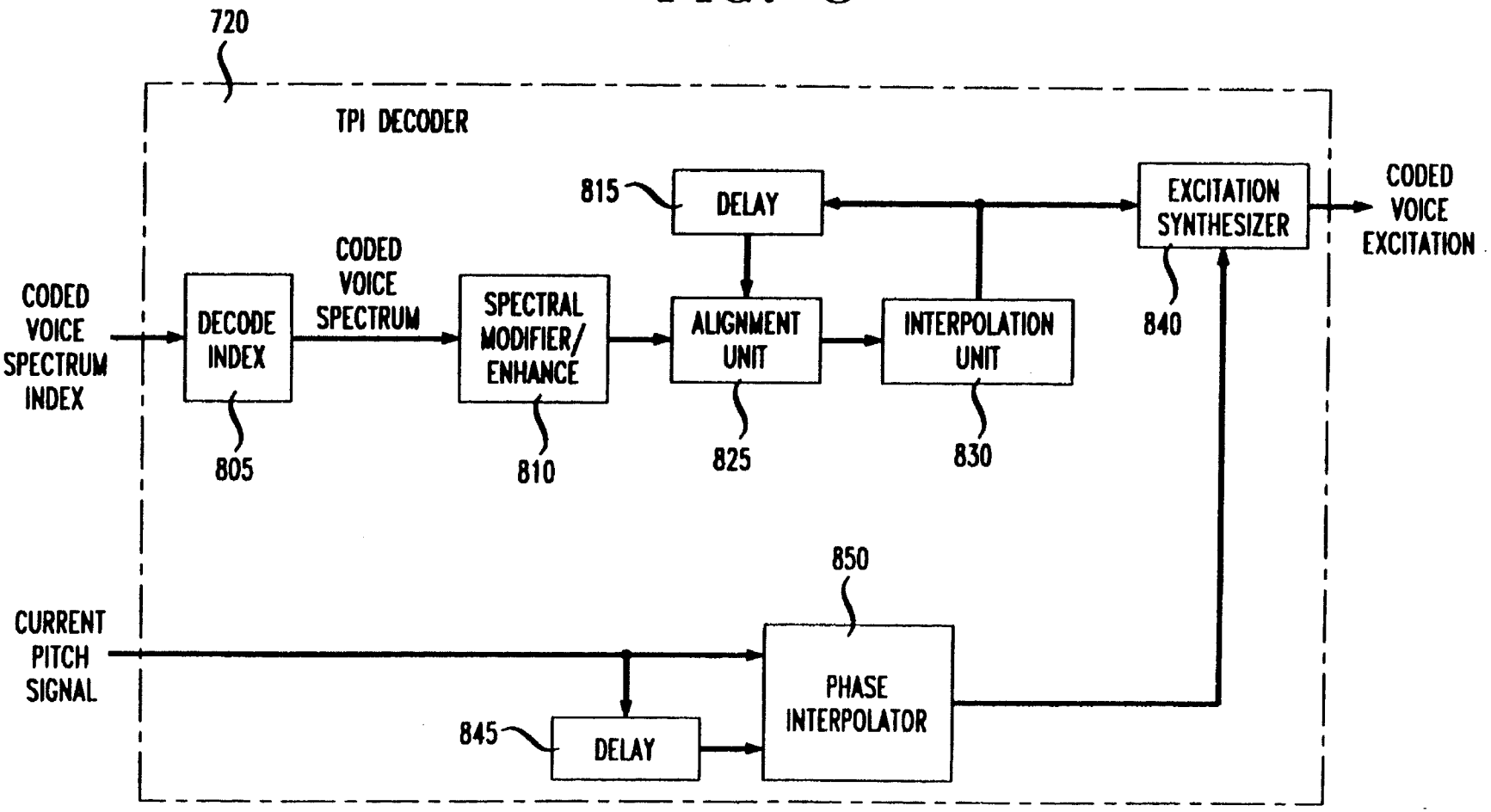
FIG. 8 illustrates a block diagram of a TFI decoder.

The interpolation and synthesis operations can be duplicated at the receiver. FIG. 7 illustrates block diagram speech decoding system 107 where switch 750 selects CELP decoding or TFI decoding depending on whether the speech is voiced or unvoiced. FIG. 8 illustrates a block diagram of a TFI encoder 720. Those skilled in the art will recognize that the blocks on the TFI encoder perform similar functions as the blocks of the same name in the encoder.

Many different TFI algorithms can be envisioned within the framework formulated so far. There is no obvious systematic way of developing the best system and lots of heuristics and experimentations are involved. One way is to start with a simple system and gradually improve it by gaining more insight to the process and by eliminating one problem at a time. Along this line, we now describe in more detail three different TFI systems.

1. TFI System 1

This system is based on linear TFI as defined above. Here, spectral modification advantageously amounts only to nulling the upper 20% of the DFT components: if M is the current initial DFT size (half the current pitch), then, X' (K) and Y(N−1,K) have only 0.8 M complex components. The purpose of this windowing is to make the following VQ operation more efficient by reducing the dimensionality.

The spectrum is quantized by a weighted, variable-size, predictive vector quantizer. Spectral weighting is accomplished by minimizing $\|H(K)[X'(K)-Y(N-1,K)]\|$ where $\|.\|$ means sum of squared magnitudes. H(K) is the DFT of the impulse response of a modified all-pole LPC filter. See Schroeder and Atal, supra; Kroon and Deprettere, supra. The quantized spectrum is now aligned with the previous spectrum by applying FCS to Y(N−1,K) as in Eq. (13). The best fractional shift is found for maximum correlation between Y'(−1,K) and Y'(N−1,K).

The interpolation and synthesis are done exactly as described in the sections above and in Eq. (11), with linear interpolation functions $\alpha(m)=1-m/N$, $\beta(m)=m/N$. The inverse DFT phase $\Psi(m)$ was interpolated assuming linear trajectory of the pitch frequency. If the previous and current pitch angular frequencies are $\omega$ and $\omega_c$, respectively, then, the phase is given simply by $$\Psi(m)=[\omega_p(1-m/N)+\omega_c m/N]m \tag{14}$$

System 1 was designed to be a LR-TFI. The excitation spectrum is updated at a low rate of once per 20 msec. interval. The frame size is, therefore, N=160 samples and includes several pitch periods. This way, quantization of the spectrum is efficient since all the available bits are used in coding one single vector per 20 msec. Indeed, the coded voiced speech sounds very smooth, without the roughness due to quantization errors, which is typical to other coders at this rate. However, as mentioned earlier, linear TFI of two spectra over a long time interval sometimes distorts the spectrum. If the difference between the pitch boundary values is great, linear TFI may imply implicit spectral aliasing. Also, some interpitch variations that are important to preserving the naturalness of the voiced speech, are sometime washed away by the interpolation process and excessive periodicity occurs.

2. TFI System 2

System 2 was designed to remove some of the artifacts of system 1 by moving from LR-TFI to HR-TFI. In system 2, the TFI rate is 4 times higher than that of system 1, which means that the TFI process is done every 5 msec. (40 samples). This frequent update of the spectrum allows for more accurate representation of the speech dynamics, without the excessive periodicity typical to system 1. Increasing the TFI rate, however, creates a heavy burden on the quantizer since much more data has to be quantized per unit time.

The approach to this problem was to significantly reduce the size of data to be quantized by modifying the spectrum as:

$$X'(K)=\begin{cases} X(K) & 0 \leqq K \leqq L-1 \\ 0 & \text{Otherwise} \end{cases} \tag{15}$$

For the current pitch period P, the window width is given by $$L=\min\{0.4\,P,\ 20\} \tag{16}$$

which means that the dimensionality of the vector quantizer is never higher than 20. The use of magnitude-only spectrum amounts to data reduction by a factor of 2. While the spectral shape is preserved, removing the phase causes the synthesized excitation to be more spiky. This sometimes causes the output speech to sound a bit metallic. However, the advantage of achieving higher quantization performance outweighs this minor disadvantage. The quantization of the spectrum is performed 4 times more frequently than in the case of system 1, with essentially the same number of bits per 20 msec. interval. This is made possible by reducing the VQ dimension.

When 0.4 P>20, the operation defined by Eqs. (15) and (16) means lowpass filtering. To avoid this effect, the quantized spectrum is extended or demodified, as shown in FIG. 5 by the spectral demodified enhancer 405, by assigning the average value of the magnitude-spectrum to all locations of the missing data:

$$Y(N-1,K)=\frac{1}{20}\sum_{K=0}^{19} Y(N-1,K);\ K=20,\ldots,0.4\,P \tag{17}$$

This is based on the assumption that, since the LPC residual is generally white, the missing DFT components would have about the same level as the non-missing ones. Obviously, this may not be the case in many instances. However, listening tests have confirmed that the resulting spectral distortions at the high end of the spectrum is not very objectionable.

In this system, the spectrum is modified and enhanced by the non-linear operation of setting the phase to zero. Small amounts of random phase jitter make speech sound more natural. The linear interpolation and the inverse DFT still commute. Therefore, interpolation and synthesis are done much the same as in system 1.

3. TFI System 3

System 3 uses the non-linear magnitude-phase LR-TFI introduced above. This is an attempt to further improve the performance by reducing the artifacts of both system 1 and system 2. The initial spectrum X(K) is windowed by nulling all components indexed by K≧0.4 P and then is vector quantized. The quantized spectrum Y(N−1,K) is then decomposed into a magnitude vector Y(N−1,k) and a phase vector argY(N−1,K). A sequence of spectra is then generated by linear interpolation of the magnitudes and phases, using the ones from the previous frame:

$$|Y(n,K)|=\left(1-\frac{n}{N}\right)|Y(-1,K)|+\frac{n}{N}|Y(N-1,K)| \tag{18}$$

$$\arg Y(n,K)=\left(1-\frac{n}{N}\right)\arg Y(-1,K)+\frac{n}{N}\arg Y(N-1,K)$$

$$\text{for } n=0,\ldots,N-1;\ K=0,\ldots,K_{max}$$

In the above vector-interpolation, the vector size is $K_{max}$. This is the maximum of previous and current spectrum sizes. The shorter spectrum is extended to $K_{max}$ by zero-padding. Note that the interpolated phases are close to those of the source spectrum only towards the frame boundaries. The intermediate phase vectors are somewhat arbitrary since the linear interpolation does not mean good approximation to the desired phase in any quantitative sense. However, since the magnitude spectrum is preserved, the interpolated phases act similar to the true ones in spreading the signal and, thus, the spikiness of system 2 is eliminated.

The vector interpolation as defined above does not take care of possible spectral aliasing or distortions in the case of a large difference between the spacings of the two boundary spectra. Better interpolation schemes, in this respect, will be studied in the future.

Each complex spectrum Y(n,K), formed by the pair {Y(n,K), argY(n,K)}, is FCS-ed to maximize its correlation with Y(−1,K), which yields the aligned spectra Y'(n,K). Inverse DFT is now performed, with the phase Ψ(m) as in (14). The resulting waveforms y(n,k) are then weight-summed by the operator $W_n$, as in (2), using simple rectangular functions w(n,m) of width Q, defined by:

$$w(n, m) = \begin{cases} \frac{1}{Q} & m - Q/2 < n < m + Q/2,\ 0 \leqq n, m \leqq N-1 \\ 0 & \text{otherwise} \end{cases} \quad (19)$$

This means that each waveform y(n,m) contributes to the final waveform z(m) only locally. A good value for the window size Q can only be found experimentally by listening to processed speech.

This disclosure deals with time-frequency interpolation (TFI) techniques and their application to low-rate coding of voiced speech. The disclosure focuses on the formulation of the general TFI framework. Within this framework, three specific TFI systems for voiced speech coding are described. The methods and algorithms have been described without reference to specific hardware or software. Instead, the individual stages have been described in such a manner that those skilled in the art can readily adapt such hardware and software as may be available or preferable for particular applications.

I claim:

1. A method of encoding a speech signal comprising the steps of:

sampling a speech signal to form a sequence of samples;

forming a plurality of spectra in a time-frequency domain, wherein each spectrum in said plurality of spectra is associated with a sample in said sequence of samples and wherein each spectrum is generated from a contiguous plurality of samples;

decimating said plurality of spectra in said time-frequency domain to form a decimated set of spectra.

2. The method of claim 1 wherein said plurality of spectra further comprises forming a reduce-sized parametric representation of said set of decimated spectra.

3. A method of decoding a coded speech signal, wherein said coded speech signal comprises a decimated set of spectra, said method comprising the steps of:

interpolating said decimated set of spectra in a time-frequency domain to form a complete spectrum sequence;

inverse transforming, from said time-frequency domain to a time-time domain, said complete spectrum sequence to form a set of inverse transformed signals, wherein each inverse transformed signal in said set of inverse transformed signals is a two-dimensional signal;

windowing, using a two dimensional time-time window function, said set of inverse transformed signals to form a one-dimensional windowed signal; and generating a reconstructed speech signal based on said windowed signal.

4. The method of claim 3 wherein said step of interpolating comprises linear interpolation.

5. The method of claim 3 wherein each spectrum in said plurality of spectra comprises a set of coefficients, each coefficient in said set of coefficients having a magnitude component and phase component, and wherein said step of interpolating is applied non-linearly and separately to said magnitude and phase component.

6. The method of claim 3 wherein said step of inverse transforming is according to the rule $$y(n, m) = \sum_{K=0}^{M(n)-1} Y(n, K)\, e^{j\frac{2\pi K}{M(n)} c(m)m}$$

where y(n,m) is said set of signals, Y(n,K) is said complete spectrum sequence and c(m) is a discrete time scale function.

7. A method for decoding a coded plurality of speech signals, said signals representing:

a first index associated with an entry in a look-up table wherein said entry represents a plurality of parameters characterizing said speech signal, a second index associated with an entry in a second look-up table wherein said entry represents a pitch signal for said speech signal, and a third index associated with an entry in a third look-up table wherein said entry represents a spectrum of said speech signal, said method comprising the steps of:

determining said parameters characterizing said speech signal based on said first index;

determining said pitch signal based on said second index;

determining said spectrum based on said third index;

modifying and enhancing said spectrum to form a modified spectrum;

aligning said modified spectrum with the spectrum of a speech signal from a prior frame;

interpolating between said spectrum and the spectrum of a speech signal from a prior frame to yield a complete spectrum sequence;

inverse transforming said second spectrum to yield a set of signals;

windowing said set of signals to yield a windowed signal; and filtering said windowed signal, wherein said filter characteristics are determined by said parameters.

8. A method for encoding a speech signal, said method comprising the steps of:

generating a plurality of parameters characterizing said speech signal;

quantizing said plurality of parameters to form a set of quantized parameters;

selecting an index associated with an entry in a first codebook which entry best matches said quantized parameters in accordance with a first error measure;

determining a pitch period for said speech signal; , selecting an index associated with an entry in a second codebook which entry best matches said pitch period in accordance with a second error measure;

inverse filtering said speech signal to produce an excitation signal using filter parameters determined by said set of quantized parameters;

for each sample in said excitation signal, selecting a pitch-sized segment of said excitation signal as a segment in a set of segments, wherein each segment is associated with a unique sample in said excitation signal;

transforming each segment in said set of segments to yield a corresponding spectrum a set of spectra wherein said set of spectra are represented in a time-frequency domain;

modifying said each corresponding spectrum in said set of spectra to form a corresponding modified spectrum in a set of modified spectra;

decimating said set of modified spectra to yield a decimated set of spectra;

quantizing each spectrum in said set of decimated spectra to form a respective quantized spectrum in a set of quantized spectra;

selecting, for each quantized spectrum, an index associated with an entry in a third codebook which entry best matches said quantized spectrum in accordance with a third error measure;

enchancing each quantized spectrum;

aligning said each enhanced quantized spectrum with a spectrum of said speech signal from a prior frame;

interpolating between each aligned enhanced quantized spectrum and said spectrum of said speech signal from a prior frame to find spectra for other samples in said frame to yield a complete spectrum sequence, wherein said complete spectrum sequence comprises a set of quantized spectra, wherein each quantized spectrum corresponds to a sample of said speech signal;

inverse transforming said complete spectrum sequence to yield a set of two-dimensional signals in the time-time domain; and two-dimensional windowing said set of two-dimensional signals to yield a windowed one-dimensional signal.

9. The method of claim 8 wherein said step of generating a plurality of parameters comprises identifying characteristics of said speech signal indicating that the speech is voiced speech.

10. The method of claim 8 wherein said plurality of parameters are generated by linear predictive coding.

11. The method of claim 8 wherein said step of forming a plurality of parameters characterizing said speech signals comprises the steps of:

identifying whether said speech signals represent voiced speech, and when said identifying fails to identify voiced speech, forming a second coded signal using alternative coding techniques.

12. The method of claim 11 wherein said alternative coding technique is code-excited linear predictive coding.

13. The method of claim 8 wherein said transforming is according to a discrete Fourier transform rule with a period approximately equal to said pitch period.

14. The method of claim 8 wherein said step of quantizing each spectrum is according to predictive weighted vector quantization.

15. The method of claim 8 wherein said interpolation is according to the rule:

$$z(m) = \alpha(m)y(-1, m) + \beta(m)y(N-1, m)$$

where $$\alpha(m) = \sum_{n=0}^{N-1} w(n, m)\alpha(n)\ \beta(m) = \sum_{n=0}^{N-1} w(n, m)\beta(n)$$

where w(n,m) is a windowing function and where y(−1,m) is an aligned enhanced quantized spectrum and where y(N−1,m) is said speech spectrum.

16. A system for encoding a plurality of speech signals, wherein each of said speech signals comprises a sequence of samples occurring during a time frame and wherein said time frames are contiguous, said system comprising:

means for generating a plurality of parameters characterizing said speech signal;

means for quantizing said plurality of parameters to form a set of quantized parameters;

means for selecting an index associated with an entry in a first codebook which entry best matches said quantized parameters in accordance with a first error measure;

means for determining a pitch period for said speech signal;

means for selecting an index associated with an entry in a second codebook which entry best matches said pitch period in accordance with a second error measure;

means for inverse filtering said speech signal to produce an excitation signal, wherein said means for inverse filtering comprises a filter with filter parameters determined by said set of quantized parameters;

for each sample in said said excitation signal, means for selecting a pitch-sized segment of said excitation signal as a segment in a set of segments, wherein each segment is associated with a uniques sample in said excitation signal;

means for transforming each segment in said set of segments to yield a corresponding spectrum in a set of spectra wherein said set of spectra are represented in a time-frequency domain;

means for modifying said said each corresponding spectrum in said set of spectra to form a corresponding modified spectrum in a set of modified spectra;

means for decimating said set of modified spectra to yield a decimated set of spectra;

means for quantizing each spectrum in said decimated set of spectra to form a respective quantized spectrum in a set of quantized spectra;

means for selecting, for each quantized spectrum, an index associated with an entry in a third codebook which entry best matches said quantized spectrum in accordance with a third error measure;

means for enchancing each quantized spectrum;

means for aligning said each enhanced quantized spectrum with a spectrum of said speech signal from a prior frame;

means for interpolating between each aligned enhanced quantized spectrum and said spectrum of said speech signal from a prior frame to find spectra for other samples in said frame to yield a complete spectrum sequence, wherein said complete spectrum sequence comprises a set of quantized spectra, wherein each quantized spectrum corresponds to a sample of said speech signal;

means for inverse transforming said complete spectrum sequence to yield a set of two-dimensional signals in the time-time domain; and means for two-dimensional windowing said set of two-dimensional signals to yield a windowed one-dimensional signal.

17. A system for decoding a coded plurality of speech signals, said signals representing:

a first index associated with an entry in a look-up table wherein said entry represents a plurality of parameters characterizing said speech signal, a second index associated with an entry in a second look-up table wherein said entry represents a pitch signal for said speech signal, and a third index associated with an entry in a third look-up table wherein said entry represents a spectrum of said speech signal, said system comprising:

means for determining said parameters characterizing said speech signal based on said first index;

means for determining said pitch signal based on said second index;

means for determining said spectrum based on said third index;

means for modifying and enhancing said spectrum to form a modified spectrum;

means for aligning said modified spectrum with the spectrum of a speech signal from a prior frame;

means for interpolating between said spectrum and the spectrum of a speech signal from a prior frame to yield a complete spectrum sequence;

means for inverse transforming said second spectrum to yield a set of signals;

means for windowing said set of signals to yield a windowed signal; and means for filtering said windowed signal, wherein said filter characteristics are determined by said parameters.

18. A system for encoding a speech signal comprising:

means for forming a plurality of spectra in a time-frequency domain, wherein each spectrum in said plurality of spectra is associated with a sample in said sequence of samples and wherein each spectrum is generated from a contiguous plurality of samples;

means for decimating said plurality of spectra in said time frequency domain to form a decimated set of spectra.

19. A system for decoding a coded speech signal, wherein said coded speech signal comprises a decimated set of spectra, said system comprising:

means for interpolating said decimated set of spectra in a time-frequency domain to form a complete spectrum sequence;

means for inverse transforming, from said time frequency domain to a time-time domain, said complete spectrum sequence to form a set of inverse transformed signals, wherein each inverse transformed signal in said set of inverse transformed signals is a two-dimensional signal;

means for windowing said set of inverse transformed signals to form a windowed signal; and means for generating a reconstructed speech signal based on said windowed signal.

* * * * *